US008474884B2

(12) United States Patent
Helisten et al.

(10) Patent No.: US 8,474,884 B2
(45) Date of Patent: Jul. 2, 2013

(54) DOOR LOCK

(75) Inventors: Mika Helisten, Ylämylly (FI); Jari Kervinen, Joensuu (FI)

(73) Assignee: Abloy Oy, Joensuu (FI)

( * ) Notice: Subject to any disclaimer, the term of this patent is extended or adjusted under 35 U.S.C. 154(b) by 167 days.

(21) Appl. No.: 12/597,630

(22) PCT Filed: Apr. 9, 2008

(86) PCT No.: PCT/FI2008/050173
§ 371 (c)(1),
(2), (4) Date: Oct. 26, 2009

(87) PCT Pub. No.: WO2008/132273
PCT Pub. Date: Nov. 6, 2008

(65) Prior Publication Data

US 2010/0148522 A1 Jun. 17, 2010

(30) Foreign Application Priority Data

Apr. 27, 2007 (FI) ..... 20075296

(51) Int. Cl.
*E05C 1/06* (2006.01)
*E05C 1/08* (2006.01)
*E05C 1/02* (2006.01)

(52) U.S. Cl.
USPC ..... 292/138; 292/163; 292/137

(58) Field of Classification Search
CPC . E05C 1/10; E05B 63/20; E05B 47/002; E05B 59/00; E05B 13/004; E05B 47/0004
USPC ..... 292/137, 138, 144, 244, 163; 70/107, 70/111, 150, 151 R, 151 A
See application file for complete search history.

(56) References Cited

U.S. PATENT DOCUMENTS 2,209,551 A * 7/1940 Anderson ..... 292/49
3,361,464 A * 1/1968 Foster ..... 292/245
4,902,053 A 2/1990 Hakkarainen et al.
5,113,676 A * 5/1992 Panossian ..... 70/418
5,249,831 A * 10/1993 Maniaci ..... 292/144

(Continued)

FOREIGN PATENT DOCUMENTS

EP 1291479 A 3/2003
FI 871601 A 10/1988

(Continued)

OTHER PUBLICATIONS

Marko Keranen, Office action and search report for FI 20075296, Feb. 21, 2008, Finland.

(Continued)

*Primary Examiner* — Kristina R Fulton
*Assistant Examiner* — Nathan Cumar
(74) *Attorney, Agent, or Firm* — Muncy, Geissler, Olds & Lowe, PLLC

(57) ABSTRACT

A door lock with a bolt, wherein the bolt pieces of the dual-action bolt are prevented from turning away from each other as the bolt pieces have two projections (24, 26) arranged to cooperate with the inner surface (30) of the front plate. In relation to the support of the bolt piece on the shaft (29), one of the projections (26) is arranged on the opposite side in the axial direction compared to the other away-facing projection.

10 Claims, 2 Drawing Sheets

U.S. PATENT DOCUMENTS

Figure 4:
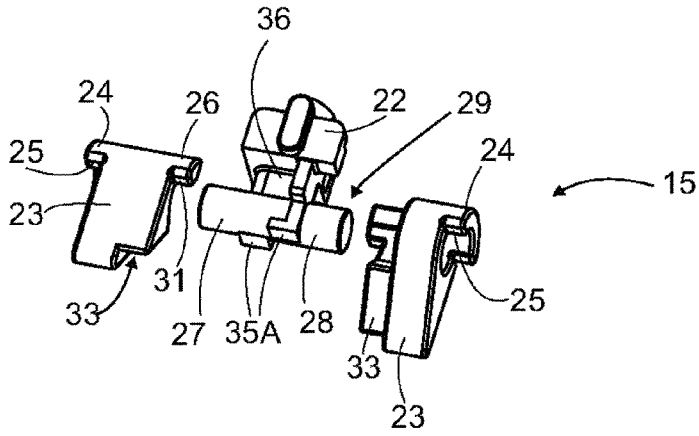

| | | | | |
|---|---|---|---|---|
| 5,311,168 | A * | 5/1994 | Pease et al. | 340/542 |
| 5,498,037 | A * | 3/1996 | Fan Lai | 292/1.5 |
| 6,349,982 | B2 * | 2/2002 | Fayngersh et al. | 292/165 |
| 6,393,878 | B1 * | 5/2002 | Fayngersh et al. | 70/107 |
| 6,578,888 | B1 * | 6/2003 | Fayngersh et al. | 292/332 |
| 6,619,705 | B2 * | 9/2003 | Dalsing | 292/169.14 |
| 6,926,315 | B2 * | 8/2005 | Kondratuk | 292/165 |
| 7,007,985 | B2 * | 3/2006 | Alexander et al. | 292/163 |

FOREIGN PATENT DOCUMENTS

| | | | |
|---|---|---|---|
| FR | 2726026 | A | 4/1996 |
| GB | 2203794 | A | 10/1988 |
| JP | 3293491 | A | 12/1991 |
| RU | 2176715 | C2 | 12/2001 |
| RU | 2181423 | C1 | 4/2002 |
| SU | 1448020 | A1 | 12/1988 |

OTHER PUBLICATIONS

Roeland Henkes, International Search Report and written opinion for PCT/FI2008/050173, Sep. 29, 2008, Netherlands.

* cited by examiner

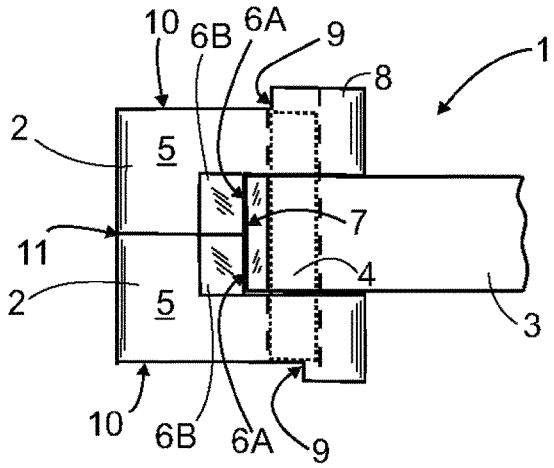
FIG.1
FIG.2
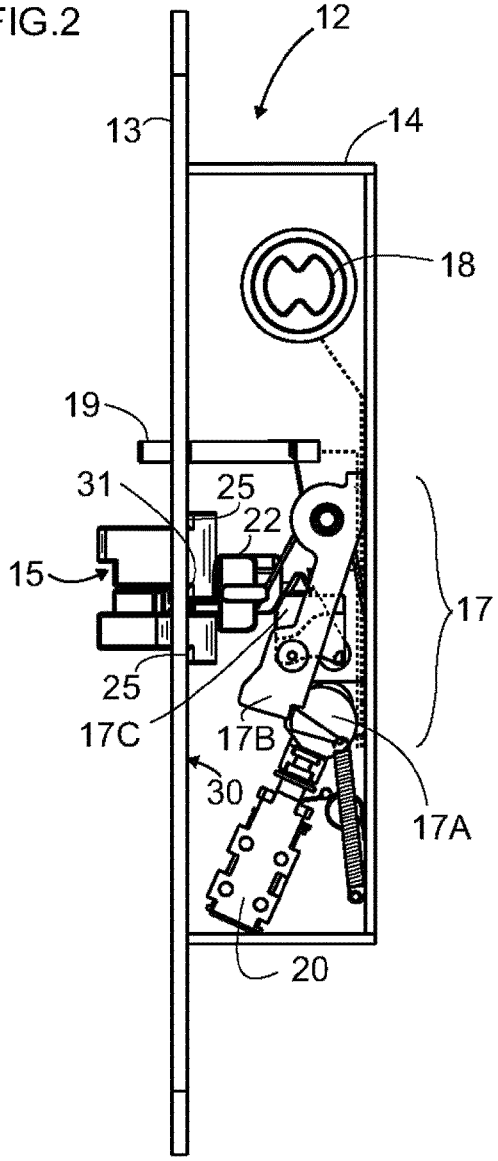
FIG.3
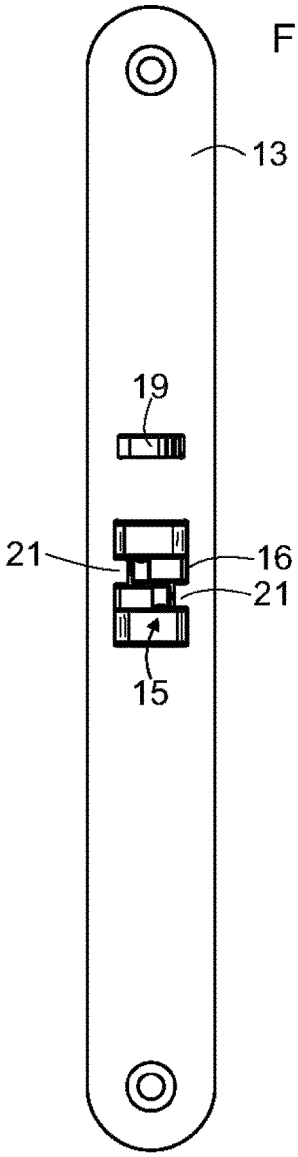

DOOR LOCK

This is a national stage application filed under 35 USC 371 based on International Application No. PCT/FI2008/050173 filed Apr. 9, 2008, and claims priority under 35 USC 119 of Finnish Patent Application No. FI 20075296, filed Apr. 27, 2007.

FIELD OF TECHNOLOGY

This invention relates to a door lock with a dual-action bolt, the dual-action bolt comprising a body part fitted with a shaft in the longitudinal direction of the front plate of the door lock, as well as two bolt pieces that are pivotably supported on the body part around its shaft.

PRIOR ART

In many applications, a door lock must allow the door to be opened by pushing it in either direction when the deadbolting means of the door lock are in the passive state. Deadbolting means refer to means within the lock that can be used to lock the bolt in the deadbolting position. In the deadbolting position, the bolt is in a position protruding out from the lock body.

In this and other applications, the door lock comprises a dual-action bolt with two bolt pieces. Both bolt pieces are so-called bevelled bolts; that is, they have a bevelled surface that contacts a striker plate when the door is closed, making the bevelled bolt go into the lock body. The bolt pieces are pivotably fitted to the body of the dual-action body so that the bolt pieces always form a bevelled surface that contacts the striker plate when the door is turned shut, regardless of the direction in which the door is turned.

FIG. 1 illustrates a prior art dual-action bolt 1 with two bolt pieces 2, a body 3 and a shaft 4 arranged in connection with the body. The bolt pieces are linked pivotably on the shaft. The figure illustrates the bolt from the side, in a situation where both bolt pieces are turned to the same direction; in other words, the striker plate has pressed the bolt piece to the same position as the other bolt piece at door closure. In this case the side surfaces 5 of the bolt pieces form a congruent bevelled surface. The bolt pieces have limiter surfaces 6A, 6B to limit the turning of the bolt. In the extreme position of the bolt piece, either of the bolt piece's limiter surfaces is against the body support surface 7, preventing the bolt piece from pivoting in relation to the shaft. In the situation illustrated in FIG. 1, the bolt pieces are in the extreme position in which they cannot turn any further away from the viewer. The bolt pieces in FIG. 1 can be turned towards the viewer until the second limiter surfaces 6B of the bolt pieces contact the body support surface 7.

Both bolt pieces also have a projection 8 in the longitudinal direction of the shaft 4 directed away from the bolt body part 3. The projections have a counter surface 9 that is arranged to cooperate with the inner surface of the front plate of the door lock. When the dual-action bolt protrudes out from the lock body to the protruding position, the counter surface 9 of the projection in either bolt piece contacts the inner surface of the front plate (in FIG. 1, the counter surface of the upper bolt piece). Thus the inner surface of the front plate guides the bolt piece to turn to the extreme position opposite to that where the other bolt piece is located. In other words, the bolt pieces of a dual-action bolt are in opposite extreme positions when the bolt is in the protruding position.

The problem with a door lock having a dual-action bolt is that in operation, the bolt pieces 2 tend to turn away from each other in the vertical direction. Turning of the bolt pieces causes uneven wear in the shaft 4, both in the shaft journal and the shaft bore. This expands the gap 11 between the bolt pieces, and the end edges 10 of the bolt pieces chafe against the edges of the bolt opening in the front plate. Chafing of the end edges against the edges of the bolt openings hampers the operation of the lock and may even cause a malfunction as the bolt no longer moves properly in and out of the lock body. Furthermore, when opening/closing the door, the force is initially imposed primarily on one of the bolt pieces, due to which the body of the bolt tends to turn within the lock body. This turning must be taken into account in the other structures of the lock in order to ensure flawless operation.

SHORT DESCRIPTION OF INVENTION

The objective of the invention is to reduce the turning of the bolt pieces of a dual-action bolt away from each other. The objective will be achieved as described in the independent claim. The dependent claims describe various embodiments of the invention.

The inventive idea is that unwanted turning of the bolt pieces can be reduced or even completely prevented if the bolt pieces also have another projection that is arranged to cooperate with the inner surface of the front plate. In relation to the support of the bolt piece on the shaft, the second projection is arranged on the opposite side in the axial direction compared to said away-facing projection. The second projection has a second counter surface that is arranged to cooperate with the inner surface of the front plate.

LIST OF FIGURES

Figure 5A:
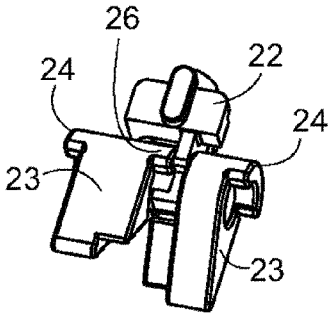
Figure 5B:
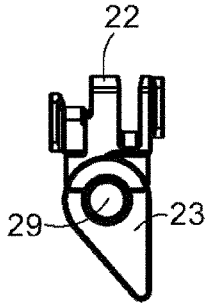
Figure 5C:
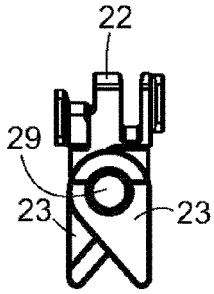
Figure 5D:
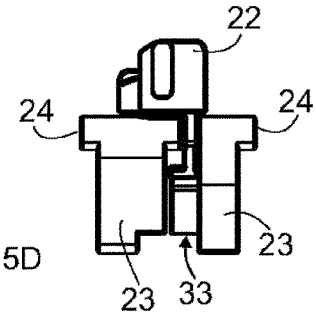
Figure 6A:
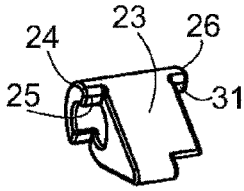
Figure 6B:
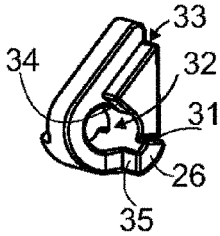
Figure 6C:
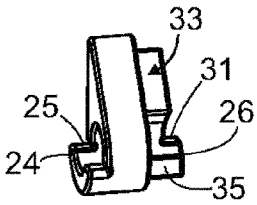
Figure 7:
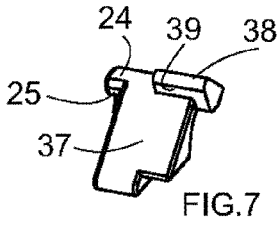

In the following, the invention is described in more detail by reference to the enclosed drawings, where FIG. 1 illustrates an example of a prior art dual-action bolt, FIG. 2 illustrates an example of a door lock according to the invention viewed from the side, FIG. 3 illustrates an example of a door lock according to the invention viewed from the front side of the front plate, FIG. 4 illustrates an example of a door lock bolt with the parts separated, FIGS. 5A-5D illustrate the door lock bolt with the parts together, FIGS. 6A-6C illustrate an example of a bolt piece for the door lock bolt, and FIG. 7 illustrates an example of another embodiment of the bolt piece.

DESCRIPTION OF THE INVENTION

FIG. 2 illustrates an example of a door lock 12 according to the invention. The door lock comprises a lock body 14 fitted with a front plate 13; the lock body has a dual-action bolt 15 that can be moved with reciprocating linear motion between a withdrawn position and a protruding locking position out from the lock body through a bolt opening 16 (FIG. 3) in the front plate 13. The bolt is spring-loaded (like normally in door locks) towards said protruding position.

The door lock further comprises deadbolting means 17 that can be moved to a deadbolting position in which they prevent the dual-action bolt from being moved from the protruding position to the withdrawn position in the lock body 14. The deadbolting means in the example of FIG. 2 are locked in the deadbolting position. In the example, the roller 17A in the deadbolting means prevents the locking lever 17B and the locking element 17C from moving out of the deadbolting position.

The door lock also usually comprises control means for controlling the deadbolting means. The lock may have an electrically controlled solenoid 20, an auxiliary bolt 19 and/or control spindle means 18. The auxiliary bolt prevents the bolt from moving to deadbolting position when the door is open but allows it when the door is closed. The control spindle means 18 comprises, for example, a cylinder body, a handle and/or a knob. The connection from the control spindle means and auxiliary bolt to the roller 17A within the deadbolting means is simply marked with dashed lines. The solenoid 20 is linked to the roller 17A through the solenoid spindle.

FIGS. 4 and 5A-5D illustrate the dual-action bolt of the door lock according to the invention. FIGS. 6A-6C illustrate the bolt piece of the dual-action bolt viewed from different directions. The dual-action bolt 15 comprises a body part 22 fitted with a shaft 29 substantially longitudinal to the front plate 13. The dual-action shield also comprises two bolt pieces 23 that are pivotably supported on the body part 22 around its shaft 29. In FIG. 4, the bolt pieces and body parts are separated from each other. In FIGS. 5A-5D the bolt pieces are pivotably supported on the body 22. The bolt pieces have a bore 32 (FIG. 6B) for the shaft 29. The bolt pieces are fitted around the shaft so that the shaft is in the bores of the bolt pieces. The shaft section 27, 28 that is in the bore forms a support for the bolt piece, in other words a position for supporting the shaft of the bolt piece. In FIG. 5B the dual-action bolt is illustrated from the direction of the shaft 29 with the bolt pieces turned in the same direction, in which case the bolt pieces form a congruent bevelled surface. In FIG. 5C the dual-action bolt is illustrated from the shaft direction with the bolt pieces turned in different directions, in which case the bevelled surfaces of the bolt pieces are crossed.

The bolt pieces comprise a projection 24 facing away from the body part 22 in the longitudinal direction of the shaft 29, said projection having a counter surface 25 arranged to cooperate with the inner surface 30 of the front plate. Both bolt pieces also comprise a second projection 26 which, in relation to the support 27, 28 of the bolt piece on the shaft, is arranged on the opposite side in the direction of the shaft 29 compared to said away-facing projection 24. The second projection has a second counter surface 31 that is arranged to cooperate with the inner surface 30 of the front plate.

Because the dual-action bolt is spring-loaded towards the protruding position, the counter surfaces 25, 31 turn the bolt pieces to crosswise positions (FIGS. 5A and 5C) when the counter surfaces contact the inner surface 30 of the front plate. The projections also limit the protruding of the dual-action bolt out of the lock body. See FIG. 2. The bolt pieces do not tend to turn away from each other as the counter surfaces 25, 31 of the bolt piece are on opposite sides in the axial direction in relation to the shaft support position 27, 28. The second counter surface 31 prevents the bolt piece from turning away from the second bolt piece when it is against the front plate. Because the bolt piece has two counter surfaces as described above, the turning of the bolt piece in relation to the front plate is also minimised/prevented. Because turning is prevented, no uneven wear will occur on the shaft 29. This allows thinner dimensioning of the shaft.

FIGS. 6A-6C illustrate an embodiment of the bolt piece. In FIGS. 5A-5D the dual-action bolt is assembled. The second projection 26 of the bolt piece faces the second bolt piece in the direction of the shaft 29 so that the second projections 26 of the bolt pieces 23 are on opposite sides of the body 22 and the shaft 29. FIG. 3 illustrates the door lock viewed from the front, showing the bolt opening 16 in the front plate 13. The edge of the bolt opening 16 contains counter projections 21 in the front plate, and the second counter surfaces 31 are arranged to cooperate with said counter projections. A cut-out 33 is arranged in both bolt pieces for the counter projection of the second front plate in order to allow the bolt to move linearly to the protruding position. As can be seen from the figures, the second counter surface 31 of the second projection of the bolt piece is arranged in the middle section of the body 22. The figures also show that both bolt pieces of the dual-action bolt are identical.

At least one of the corners of the outward-facing projections 24 and the second projections 26 of the bolt pieces 23 is rounded. Rounding of the corner or corners aims to reduce wear and tear due to operation. FIG. 4 shows that the body 22 and its shaft 29 are a solid integral part, for example a cast part. However, it is also possible that there is a bore in the bolt body into which the body shaft can be fitted separately.

The figures show that both bolt parts have a bore 32 for the body shaft 29 (FIG. 6B). In the example of the figures presented, a first limiter surface 34 is arranged in connection with the bore to limit the bolt part from turning in relation to the shaft. The first limiter surface is a surface tangential to the edge of the bore. The surface 35 of the bolt part's second projection 26 on the opposite side in relation to the second mating surface 31 forms a second limiter surface to limit the turning of the bolt part to the other direction. The body 22 of the dual-action bolt has first counter limiter surfaces 35A at the end of the body in a direction tangential to the shaft surface, and second counter limiter surfaces 36 at the sides of the body. The first counter limiter surfaces 35A are arranged to cooperate with the first limiter surfaces, and the second counter limiter surfaces 36 are arranged to cooperate with the second limiter surfaces. The purpose of the limiter surfaces is to prevent excessive turning of the bolt piece in relation to the shaft. FIGS. 5B and 5C illustrate the bolt parts in their extreme positions. If the bolt pieces were allowed to turn more, the reciprocating linear movement of the bolt in the bolt opening of the front plate and the bolt opening of the striker plate would be hampered or even prevented. The limiter surfaces can be manufactured precisely when they are located immediately next to the bore in the bolt piece. This reduces excess turning of the bolt pieces due to manufacturing tolerances.

FIG. 7 illustrates a second embodiment of the bolt piece 37 in which the second projection 38 with its counter surfaces 39 is a projection transverse to the longitudinal direction of the shaft, extending away from the shaft (preferably in the radial direction of the shaft). In a door lock with a dual-action bolt using the bolt pieces of this embodiment, the second projection 38 is arranged to cooperate with the inner surface 30 of the front plate that is on the side edge of the bolt opening 16. In this case the bolt piece is not necessarily required to have a cut-out 33 or a projection in the direction of the shaft facing the other bolt piece.

It is clear that a door lock according to the invention can also be implemented with types of dual-action bolts other than those illustrated in the figures. For example, the side of the body part 22 facing the locking means 17 can be shaped differently. Therefore any inventive embodiment can be implemented within the scope of the inventive idea.

The invention claimed is:

1. A door lock comprising:

a lock body, a front plate fitted to the lock body and formed with a bolt opening, a dual-action bolt that is movable linearly relative to the front plate between a withdrawn position in the lock body and a protruding locking position in which the bolt projects from the lock body through the bolt opening in the front plate, said bolt being spring-loaded towards said protruding position and comprising a body part, a shaft projecting from the body part in a longitudinal direction relative to the front plate, and two bolt pieces pivotably supported on the shaft of the body part, and a deadbolting means that can be moved to a deadbolting position in which it prevents the dual-action bolt from being moved from the protruding position to the withdrawn position, and wherein each bolt piece comprises a bolt part that projects through the bolt opening when the bolt is in the protruding position, a first projection extending away from the bolt part in a longitudinal direction of the shaft and having a first counter surface arranged to directly cooperate with an inner surface of the front plate when the bolt is in the protruding position, and a second projection which, in relation to the support of the bolt piece on the shaft, is arranged on an opposite side of the bolt part in an opposite longitudinal direction of the shaft as compared to the first projection and having a second counter surface arranged to cooperate with the inner surface of the front plate, and wherein a portion of the first projection and a portion of the second projection share a same plane.

2. A door lock according to claim 1, wherein the second projection of the first bolt piece faces the second bolt piece in the direction of the shaft so that the second projections of the bolt pieces are on opposite sides of the body part and the shaft, and the front plate includes counter projections at edges of the bolt opening, the second counter surfaces being arranged to cooperate with the inner surface of the front plate at said counter projections, and each bolt piece has a cut-out to prevent interference between the bolt pieces and the counter projections when the bolt moves to the protruding position.

3. A door lock according to claim 2, wherein the second counter surface of the second projection of the first bolt piece is disposed in a middle section of the body.

4. A door lock according to claim 1, wherein at least one corner of the first projection is rounded and at least one corner of the second projection is rounded.

5. A door lock according to claim 1, wherein the body part and the shaft are a solid integral part.

6. A door lock according to claim 1, wherein the two bolt pieces have respective bores for receiving respective segments of the shaft, each bolt piece has a first limiter surface for engaging a first counter limiter surface of the body part to limit turning of the bolt piece in a first direction about the shaft and a second limiter surface for engaging a second counter limiter surface of the body part to limit turning of the bolt piece in a second direction about the shaft, the first limiter surface is tangential to an edge of the bore, the first counter limiter surface is tangential to a surface of the shaft, and the second limiter surface is a surface of the second projection of the bolt part.

7. A door lock according to claim 1, wherein the second projection of each bolt piece projects transverse to the longitudinal direction of the shaft and extends away from the shaft.

8. A door lock according to claim 7, wherein the second projection cooperates with the inner surface of the front plate that is on the side edge of the bolt opening.

9. A door lock according to claim 1, wherein the second projection of each bolt piece extends away from the bolt part of the bolt piece in a longitudinal direction of the shaft opposite the direction in which the first projection extends.

10. A door lock according to claim 1, wherein the second counter surface is arranged to directly cooperate with an inner surface of the front plate when the bolt is in the protruding position.

* * * * *